United States Patent [19]

Kaufman

[11] Patent Number: 4,618,185

[45] Date of Patent: Oct. 21, 1986

[54] ERGONOMIC CHAIR

[76] Inventor: Yaacov Kaufman, 17 Alexander Yanai, Tel-Aviv, Israel

[21] Appl. No.: 777,263

[22] Filed: Sep. 18, 1985

[30] Foreign Application Priority Data

Sep. 19, 1984 [IL] Israel ..... 73031

[51] Int. Cl.[4] ..... A47C 3/00

[52] U.S. Cl. ..... 297/285; 297/287; 297/294

[58] Field of Search ..... 297/285, 287, 290, 294, 297/296, 281, 264, 286, 300

[56] References Cited

U.S. PATENT DOCUMENTS

| | | | |
|---|---|---|---|
| 196,126 | 10/1877 | Petterson | 297/287 |
| 1,377,600 | 5/1921 | Prest | 297/294 |
| 2,135,833 | 11/1938 | Oermann | 297/287 |
| 2,273,980 | 2/1942 | Moody | 297/287 |
| 2,981,315 | 4/1961 | Schaffer | 297/287 |

FOREIGN PATENT DOCUMENTS

| | | | |
|---|---|---|---|
| 946197 | 12/1948 | France | 297/287 |
| 400876 | 11/1933 | United Kingdom | 297/287 |

*Primary Examiner*—Francis K. Zugel

*Attorney, Agent, or Firm*—Birch, Stewart, Kolasch & Birch

[57] ABSTRACT

An ergonomic chair comprising:

a substantially rigid seat structure (2,2'), a substantially rigid back structure (1,1'), articulated to the seat structure, a base (5,5') resting on the floor, a legs structure comprising on each side a pair of crossing legs (3,3', 4,4'), one (4,4') of which is articulated at the upper end to the front portion of the seat structure (2,2'), is provided with a slider (8,8') for the other leg (3,3') and is bound at the lower end to the base (5,5'), whereas the other leg (3,3'), which is elastically bending deformable, is articulated at the upper end to the back structure (1,1'), leans against a back stud (9,9') applied to the seat structure (2,2') engages with the slider (8,8') foreseen in the other leg (4,4') and is bound at the lower end to the base (5,5').

10 Claims, 8 Drawing Figures

ERGONOMIC CHAIR

The present invention relates to an ergonomic chair.

Work chairs are well known (i.e. pianist chair, draftsman chair, secretarial chair and so on) suitable for being adjusted according to the user's shape and comfort. The main purpose of these chairs is to give the user a good body support to avoid fatigues and discomforts. These chairs generally have two kinds of adjustment, one of which for adjusting the height of the chair while the second for adjusting the position and/or the inclination of the back. Therefore it is obvious that anyone using such a chair must carry out an individual adjustment for adapting it to his own requirements.

An aim of the invention is to realize a chair which can automatically and elastically adapt its position to the user's movements and particularly incline forward when the user leans forward and incline backward when the user leans backward.

Another aim of the invention is to realize a chair which allows adjustment of the elastic reaction arising whenever its rest position is changed.

Another aim of the invention is to realize a chair in which all the above mentioned features can be obtained by an article which has no mechanism and therefore is very simple and robust, has a reliable and certain operating and a limited cost.

A further aim of the invention is to realize a chair which can be disassembled, thus making easy the packing, storing and transport operations.

According to the invention all these aims are achieved by an ergonomic chair characterized in that it comprises:

- a substantially rigid seat structure,
- a substantially rigid back structure, articulated to the seat structure,
- a base resting on the floor,
- a legs structure comprising at each side a pair of crossing legs, one of which is articulated at the upper end to the front portion of the seat structure, is provided with a slider for the other leg and is bound at the lower end to the base, whereas the other leg, which is elastically bending deformable, is articulated at the upper end to the back structure, leans against a back stud applied to the seat structure, engages with the slider foreseen in the other leg and is bound at the lower end to the base.

Advantageously the legs of the chair according to the invention can be articulated to the base.

The present invention is hereinafter further clarified in two preferred embodiments with reference to the enclosed drawings in which.

Figure 1:
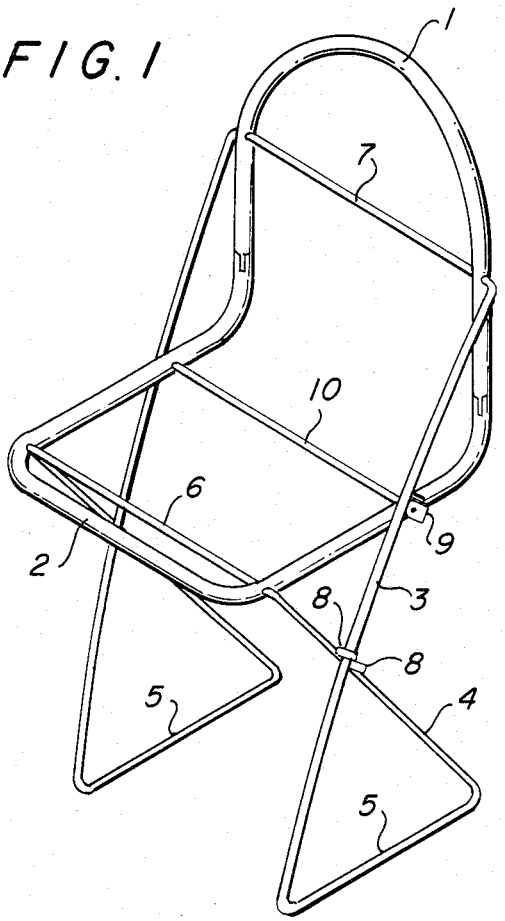
FIG. 1 is a perspective view of an ergonomic chair according to the invention in a first embodiment.

As can be seen in the drawings the chair according to the invention comprises, in the first embodiment shown in FIGS. 1 to 4, a back structure 1, articulated to a seat structure 2, both represented with a rigid tubular frame, to which any back or seat can be respectively applied.

The two structures 1 and 2, which for the sake of brevity from now on are called back 1 and seat 2, are supported by two pairs of crossing legs 3 and 4, made from an elastically flexible material, i.e., in metallic rod.

The legs of each pair are connected to each other by longitudinal rods 5 resting on the floor, whereas the corresponding legs of the two pairs are connected to each other by transversal rods 6 and 7, to which the seat 2 and the back 1 are respectively articulated.

To each leg 4 two studs 8 are applied forming a slider through which the leg 3 of the same pair passes. Furthermore to each longitudinal side of the seat 2 a further stud 9 is applied, to which the corresponding leg 3 rests. Such a stud 9 consists of a block, preferably in plastic material, articulated to the seat 2 and having the lateral surface faceted with the faces placed at different distances from the articulation pin to the seat 2. Preferably the two blocks 9 placed at both the sides of the chair are connected to each other by a rod 10, allowing their simultaneous rotational driving.

The operating of this embodiment of the ergonomic chair according to the invention is as follows.

Figure 3:
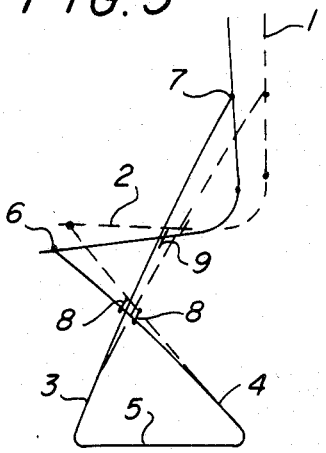
FIG. 3 is a schematic side view of the chair of FIG. 1 when it inclines forward.
Figure 4:
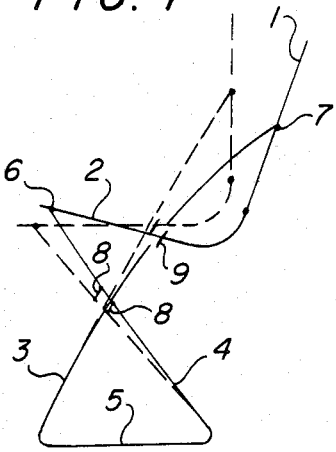
FIG. 4 is the same view as FIG. 2 when the chair inclines backward.

The whole elements forming it are a balanced set without degrees of freedom and suitable for assuming the rest configuration shown in FIG. 1 and schematically with the dotted line in FIGS. 3 and 4.

When one sits down on the chair, keeping oneself in a balanced position (standing up straight and with the balanced weight) a very slight forward flexure of the legs 4 occurs, a consequent slight lowering and advancement of the seat 2 and a slight backward flexure of the legs 3, to which a slight increase results of the angle between the seat 2 and the back 1.

Obviously the several elements have been correctly dimensioned so that a reaction of the deformed elements corresponds to this slight modification of the chair configuration such as to ensure the steadiness of the new configuration.

Figure 2:
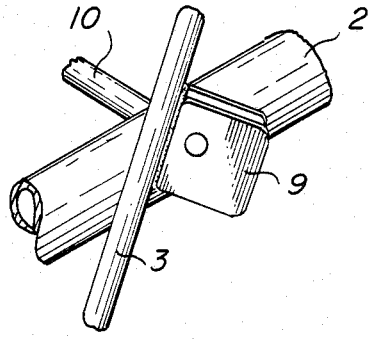
FIG. 2 is a detailed view of the stud block shown in FIG. 1.

If now the user leans forward, the legs 4 mostly flex inclining downward, the seat 2 inclines forward, consequently the stud blocks 9 advance making in their turn the legs 3 to flex forward which incline forward the back 1 (see the continuous lines in FIG. 2). If moreover the user, besides leaning forward, wishes to stand up straight, and this means to increase the angle between the seat 2 and the back 1, the chair according to the invention favors this movement owing to the flexibility of the legs 3 which, in this event, are straight or slightly bent forward at their lower portion whereas are bent backward at the upper portion.

In the case in which the user leans backward, the back 1 inclines backward, the legs 3 flex backward and also the legs 4 slightly flex backward causing the backward inclination of the seat 2 (see the continuous lines in FIG. 4). In any case the backward inclination of the back 1 is greater than the backward inclination of the seat 2 and this causes an increase of the angle formed by these, to which the elastic bending-deformation of the upper portion of the leg 3 opposes.

The function of the studs 8 is to form end-displacement limiters both for the forward and the backward inclination (both possible) of the seat 2.

The function of the blocks 9 is to oppose to the backward inclination (the only which can be caused by the user) of the back 1. In order to vary the reaction to the deformation and therefore the greater or lesser elastic backward yieldingness of the back 1 with respect to the seat 2, the possibility that the blocks 9 turn around their articulation pin to the seat 2 is foreseen, and due to the possible different position of the block surface against which the corresponding legs 3 leans, the rest predeformation of this leg and therefore its reaction to the further deformation vary.

From what has been said it clearly results that the chair according to the invention offers numerous advantages and in particular:

- it automatically adapts itself to the configuration imposed by the user and therefore can be called of the "ergonomic kind",
- it has a quite simple but at the same time very robust structure. Therefore it combines the low cost of manufacturing quality with the remarkable sturdiness and operating reliability quality,
- it is adjustable in its elastic yieldingness.

In the embodiment shown in FIGS. 5 to 8 the chair according to the invention differs from the first embodiment as follows:

- the legs 3' and 4' are articulated at their lower ends to a unique base 5' formed by a tubular stiff C-shaped element forward opened,
- the corresponding legs 3' and 4' of the two pairs are without mutual upper connections and are articulated at their upper end to the back 1 and to the seat 2 respectively, and
- the two pairs of studs 8 are replaced by two sliders 8' each applied to a leg 4' and crossed by the corresponding leg 3'.

The operating of this second embodiment of the chair according to the invention is as follows.

Figure 5:
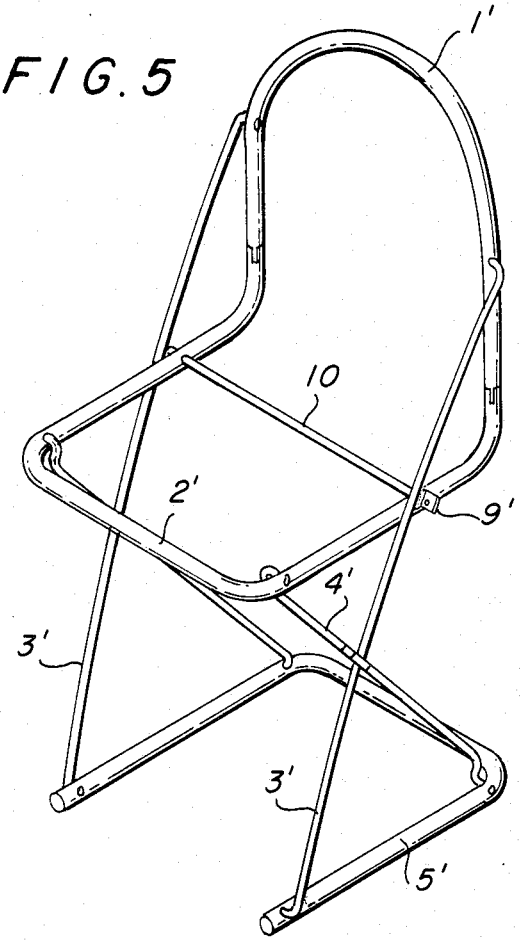
FIG. 5 is the same view as FIG. 1 of a second embodiment.
Figure 6:
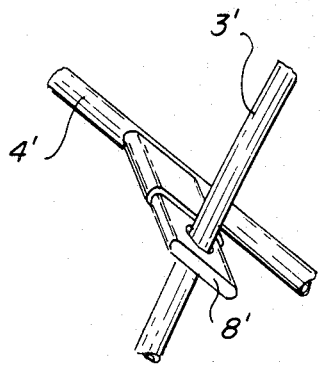
FIG. 6 is a detailed view of the crossing legs of FIG. 5.

In rest condition, the chair assumes its use configuration shown in FIG. 5. Even if the bonds between all the parts are of articulated kind, the position of the chair is well determined due to the presence of the sliders 8' which does not allow any degree of freedom to the whole system.

When the user sits down on the chair in a balanced position, the legs 4' incline forward without flexing, making the seat 2' to advance a little, whereas the legs 3' flex backward making the angle between the back 1' and the seat 2' to slightly increase.

Figure 7:
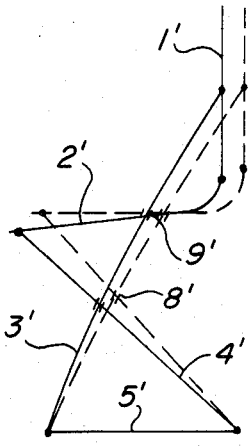
FIG. 7 is a schematic side view of the chair of FIG. 5 when it inclines forward
Figure 8:
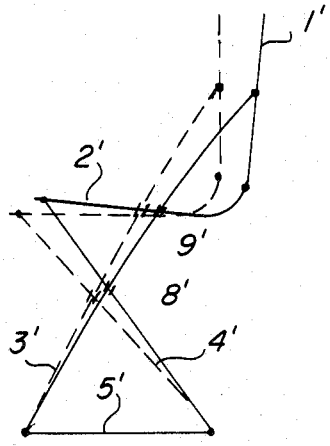
FIG. 8 is the same view as FIG. 7 when the chair inclines backward.

If then the user leans forward, the legs 4' incline further forward dragging forward the seat 2' and together this also the back 1' (see the continuous lines in FIG. 7). If also in this case the user, keeping the seat 2' inclined forward, wishes to increase the angle between the seat 2' and the back 1', he pushes backward the back 1' which elastically yields, causing the backward flexion to the legs 3'. If on the contrary the user leans backward, the legs 4' incline backward, obviously without flexing, causing the seat 2' and the back 1' to incline backward, and causing the backward flexion of the legs 3' (see the continuous lines in FIG. 8).

Furthermore if the user wishes to incline more backward the back 1' with respect to the seat 2', this is allowed up to the backward flexibility limit of the legs 3'.

The sliders 8' have a function analogous to that of the studs 8 of the previous embodiment, delimiting the forward and backward inclinations of the chair, and the studs 9' have a function analogous to that of the studs 9, delimiting the backward inclination of the seat 1'.

Besides the advantages offered by the previous embodiment, this second one offers the further advantage of allowing the complete disassembly and therefore making easier the packing, storing and transport opartions and the possible replacements of parts.

I claim:

1. An ergonomic chair characterized in that it comprises:

- a substantially rigid seat structure (2,2'),
- a substantially rigid back structure (1,1'), articulated to the seat structure,
- a base (5,5') resting on the floor,
- a legs structure comprising on each side a pair of crossing legs (3,3',4,4'), one (4,4') of which is articulated at the upper end to the front portion of the seat structure (2,2'), is provided with a slider (8,8') for the other leg (3,3') and is bound at the lower end to the base (5,5'), whereas the other leg (3,3'), which is elastically bending deformable, is articulated at the upper end to the back structure (1,1'), leans against a back stud (9,9') applied to the seat structure (2,2'), engages with the slider (8,8') foreseen in the other leg (4,4') and is bound at the lower end to the base (5,5').

2. Chair according to claim 1 characterized in that the two crossing legs (3,4) of each pair are integral with a longitudinal portion (5) resting on the floor.

3. Chair according to claim 1 characterized in that the upper ends of the corresponding legs (3,4) of each pair are connected to each other through a transversal rod (7,6) to which the back structure (1) and the seat structure (2) are respectively articulated.

4. Chair according to claim 1 characterized in that each leg (3',4') is articulated to the base (5').

5. Chair according to claim 4 characterized in that the bond between the whole elements mutually moving is of removable kind.

6. Chair according to claim 3 characterized in that the base (5') consists of a substantially stiff tubular C-shaped element forward openend to which the lower end of the crossing legs (3',4') are articulated at its side portions.

7. Chair according to claim 1 characterized in that each stud (9,9') applied to the seat structure (2,2') consists of a block having the rest surface for the leg (3,3') adjustable in position.

8. Chair according to claim 7 characterized in that each stud (9,9') consists of a block articulated to the seat structure (2, 2') and provided of several rest surfaces for the corresponding leg (3,3'), said surfaces being placed at different distance from the articulation pin of the block.

9. Chair according to claim 8 characterized in that the two blocking elements (9,9') are rotatably bound.

10. Chair according to claim 2 characterized in that the slider provided on each leg (4) consists of a pair of studs (8) spaced apart in a way corresponding to the widest movements of the chair.

* * * * *